United States Patent [19]

Wahl et al.

[11] Patent Number: 5,068,966

[45] Date of Patent: Dec. 3, 1991

[54] BLADE ASSEMBLY FOR ELECTRIC HAIR CLIPPERS

[75] Inventors: Gregory S. Wahl, Sterling; William M. Walton, Rockford, both of Ill.

[73] Assignee: Wahl Clipper Corporation, Sterling, Ill.

[21] Appl. No.: 490,937

[22] Filed: Mar. 8, 1990

[51] Int. Cl.[5] ..... B26B 19/02; B26B 19/00; B26B 19/12

[52] U.S. Cl. ..... 30/43.92; 30/220; 30/223

[58] Field of Search ..... 30/43.1, 43.2, 43.3, 30/43.7, 43.8, 43.9, 43.92, 42, 220, 221, 223, 320

[56] References Cited

U.S. PATENT DOCUMENTS

| | | | |
|---|---|---|---|
| 1,822,262 | 9/1931 | Apple | 30/320 |
| 1,956,042 | 4/1934 | Oster | 30/221 |
| 3,031,758 | 5/1962 | Wahl et al. . | |
| 3,093,901 | 6/1963 | Wahl et al. . | |
| 3,093,902 | 6/1963 | Andis | 30/223 |
| 3,222,782 | 12/1965 | Sadlon | 30/223 |
| 3,233,324 | 2/1966 | Derheide | 30/221 |
| 3,430,342 | 3/1969 | Wahl et al. . | |
| 4,498,237 | 2/1985 | Mack et al. | 30/220 |
| 4,782,592 | 11/1988 | Altamore | 30/223 |
| 4,899,444 | 2/1990 | Trichell et al. | 30/223 |

OTHER PUBLICATIONS

Device—Hair Clipper Sold by Wahl Clipper Corp., at least as early as Jul. 24, 1975.

*Primary Examiner*—Douglas D. Watts
*Assistant Examiner*—Paul M. Heyrana
*Attorney, Agent, or Firm*—Welsh & Katz, Ltd.

[57] ABSTRACT

A blade assembly for electric hair clippers includes a stationary blade having a plurality of teeth arranged in a row, and a reciprocating blade having a plurality of teeth which complement the stationary blade teeth. A cam eccentric which is turned by a shaft attached to a motor moves the reciprocating blade in a back-and-forth motion through a set operating stroke, determined by the lateral distance the cam moves during its rotation. A guide bar maintains the reciprocating blade in a blade guide parallel to the stationary blade throughout the operating stroke, but not through the maximum stroke the blade can travel when the head assembly is removed from the handle for cleaning or other servicing. Anti-lock ribs or an anti-lock bar are provided on the blade guides to engage the guide bar throughout the maximum stroke distance, thereby maintaining the reciprocating blade parallel to the stationary blade throughout the maximum stroke. The blade assembly is removably secured to the handle of the clipper by snaps or the like without the use of screws.

10 Claims, 5 Drawing Sheets

BLADE ASSEMBLY FOR ELECTRIC HAIR CLIPPERS

This invention relates to electric hair clippers and blade assemblies for electric hair clippers, and more particularly to electric hair clippers with blade assemblies which can be easily installed without screws or the like, and do not inadvertently become inoperable during normal servicing.

BACKGROUND OF THE INVENTION

Electric hair clippers and trimmers have a stationary blade and a reciprocating blade. In clippers containing a rotary electric motor the reciprocating blade is moved laterally back and forth over the stationary blade as a motor shaft turns a cam eccentric which is operatively connected to the reciprocating blade. The reciprocating blade and several associated pieces are assembled in the handle, and the stationary blade is placed over the reciprocating blade and secured to the handle by screws or the like. Installing or changing the blade assembly for servicing requires use of a special tool, such as a screw driver.

Some hair clippers have detachable blade assemblies which can be installed and removed without hand tools by securing the assembly to the handle of the clipper with snaps. The reciprocating blades in such assemblies can be held in place by wire tension springs which reciprocate with the blade, thereby creating minimal frictional loads on the motor. However, wire tension springs often do not provide accurate and rigid lateral guiding with respect to the stationary blade. The reciprocating blade can rotate to a degree, particularly under substantial cutting loads. This rotation can cause the points of the teeth of the reciprocating blade to move beyond the stationary blade and nick the skin.

Rotation of the blade can be prevented by securing the reciprocating blade with a heavier stationary metal tension spring as seen in U.S. Pat. No. 2,928,171 by J. Oster. However, because the stationary tension spring does not move with the reciprocating blade, this method of correction results in increased frictional resistance being placed on the motor, which is undesirable.

In the device of the present invention, rotation of the reciprocating blade has been reduced or eliminated by placing fixed blade guides adjacent each side of the stationary blade and installing a guide piece on the reciprocating blade. During operation, the cam eccentric rotates and moves the reciprocating blade and the guide piece through an operating stroke determined by the lateral distance the cam eccentric moves as it rotates. The guide piece is confined within the blade guides throughout the operating stroke so that the reciprocating blade can only move laterally. The reciprocating blade cannot rotate and is maintained parallel to the stationary blade, without substantially increasing the frictional resistance load on the motor.

When this type of blade assembly is detached from the clipper handle, such as for servicing, the reciprocating blade may be moved back and forth manually, to remove accumulated hair cuttings from the assembly. The reciprocating blade may also be moved in this manner if it is dropped when the assembly is detached from the handle. When moved manually, the reciprocating blade can travel through a distance which is longer than the operating stroke. Due to certain manufacturing and design constraints, explained below, it is possible for the guide piece to become disengaged from the blade guides when pushed far enough beyond one of the distal ends of the operating stroke. At this point the blade can rotate slightly, causing the guide piece to become locked against the edge of the blade guides. If the blade assembly is placed back on the handle in this condition, it will not operate.

For aesthetic reasons, it is preferably for the internal working of the blade assembly to be hidden by the solid side walls of the hair clipper case. Hair clippers are usually designed so that the case has dimensions which are as small as practical, but large enough to permit the reciprocating blade to move through its operating stroke without contacting the solid side walls of the case. In practice, the preferred case width has placed design constraints on the relative sizes of the guide piece, the blade guide and the stroke distance the reciprocating blade can travel within the handle. Due to these constraints, when the blade assembly is removed from the handle it is possible for the guide piece to be displaced from the blade guide when the guide piece is pushed beyond a distal end of the operating stroke of the reciprocating blade. The guide piece is then locked against the inside edge of the blade guide. In that event, the reciprocating blade cannot move back and forth, and when replaced on the handle, the clipper does not operate.

Thus, there is a need for blade assemblies for electric hair clippers having reciprocating blades fixed by a wire tension spring, which do not rotate under substantial cutting loads and can not be accidentally displaced out of their guide path and locked in an unmovable position when the blade assembly is removed from the handle and the reciprocating blade is pushed beyond a distal end of the operating stroke.

Accordingly, one object of this invention is to provide new and improved electric hair clippers.

Another object is to provide new and improved electric hair clippers or trimmers having blade assemblies which are easy to assembly and install, without the use of special tools.

Another object of this invention is to provide new and improved electric hair clippers which have accurate lateral guiding of the blade assembly while placing minimal frictional loads on the motor.

Still another object is to provide new and improved blade assemblies for electric hair clippers having accurate lateral guiding which cannot be accidentally displaced out of the blade guide when detached from the clipper and pushed beyond a distal end of the operating stroke.

SUMMARY OF THE INVENTION

In keeping with one aspect of this invention, a blade assembly is provided for electric hair clippers which have a handle. The blade assembly includes a base which can be snapped to the handle for operation, or removed for cleaning or other servicing, without removing screws or using hand tools. The blade assembly includes a stationary blade which has a plurality of teeth arranged in a row, and a reciprocating blade having a plurality of teeth which complement the stationary blade teeth. The stationary blade is secured to the base, and the reciprocating blade is slidably attached to the stationary blade by a wire tension spring which presses the reciprocating blade against the stationary blade, without preventing the reciprocating blade from moving back and forth. In this manner, the reciprocating blade can be manually moved laterally over a predetermined maximum stroke distance.

A cam eccentric which is turned by a shaft attached to an electric motor, powered by a suitable power means, moves the reciprocating blade in a back and forth motion over a set operating stroke. The operating stroke is less than the maximum stroke.

A guide piece is secured to the reciprocating blade. This guide piece includes guide bars which are located on each side of the guide piece and are slidably engaged in fixed blade guides adjacent the stationary blade. Through their engagement in the fixed blade guides, the guide bars prevent rotation of the reciprocating blade thereby maintaining the reciprocating blade parallel to the stationary blade throughout the operating stroke, even under heavy cutting loads. However, the guide bars cannot maintain the reciprocating blade parallel to the stationary blade once the reciprocated blade travels beyond a distal end of the operating stroke. At this point, one end of the guide bar becomes disengaged from the blade guide, and it becomes possible for the reciprocating blade to rotate slightly, causing the disengaged end of the guide bar to become locked against the inside edge of the blade guide.

Additional anti-lock ribs are located on the fixed blade guides and engage the guide bars to maintain the reciprocating blade parallel to the stationary blade when the reciprocating blade travels beyond a distal end of the operating stroke and throughout the entire maximum stroke. This keeps the reciprocating blade from being displaced out of the blade guide and locked against an inside edge of the blade guide if the reciprocating blade is moved beyond a distal end of its operating stroke when the blade assembly is removed from the handle for servicing.

BRIEF DESCRIPTION OF THE DRAWINGS

The above mentioned and other features of this invention and the manner of obtaining them will become more apparent, and will be best understood by reference to the following description, taken in conjunction with the accompanying drawings, in which.

DETAILED DESCRIPTION

Figure 1:
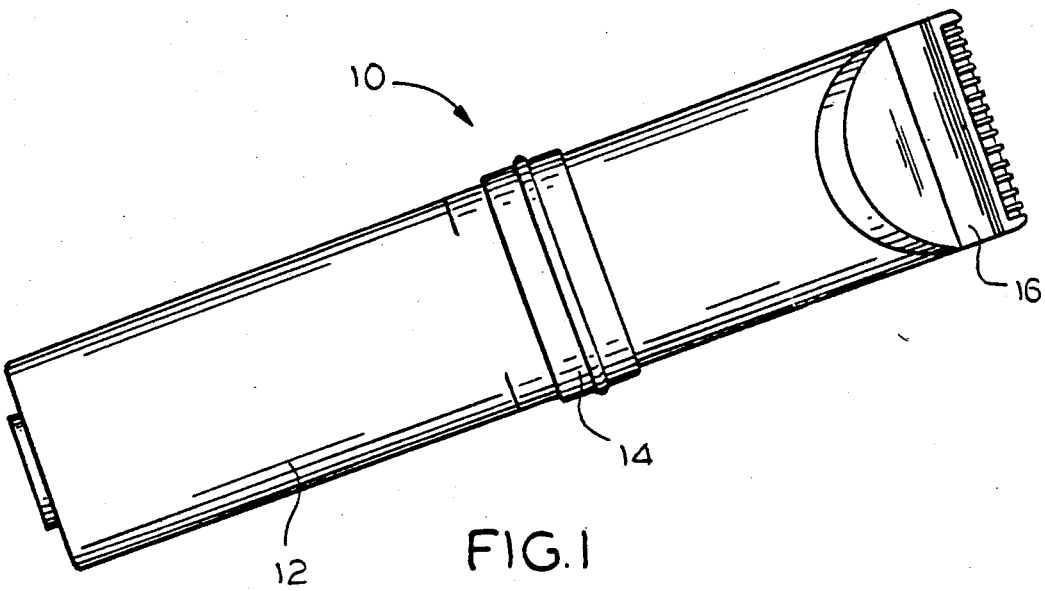
FIG. 1 is a bottom view of an assembled clipper made in accordance with this invention.

As seen in FIG. 1, hair clipper apparatus 10 includes a handle 12 having a switch 14 and a blade assembly 16.

Figure 2:
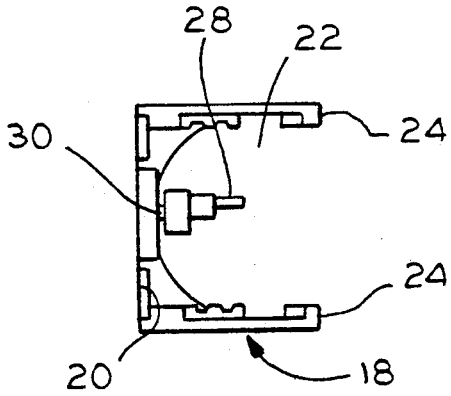
FIG. 2 is a detail view of the front end of the apparatus of FIG. 1.

The handle 12 has a front end 18 with a wall 20 and a cavity 22 (FIG. 2). The blade assembly 16 covers the cavity 22 when secured to the handle 12 (FIG. 1). The front end 18 includes a plurality of resilient protrusions 24 and a first orifice 26 (FIG. 3) for securement of the blade assembly 16. The blade assembly 16 can also be secured in any other suitable manner, such as with screws or the like.

A cam eccentric 28 is secured to a shaft 30 as seen in FIG. 2. The cam eccentric 28 is offset from the axis of the shaft 30. The cam eccentric 28 is moved in a circular motion as a motor (not shown), powered by suitable power means, causes the shaft 30 to rotate. The lateral distance the cam eccentric 28 moves determines the operating stroke distance A of the moving blade in the blade assembly 16, shown in FIG. 5.

Figure 3:
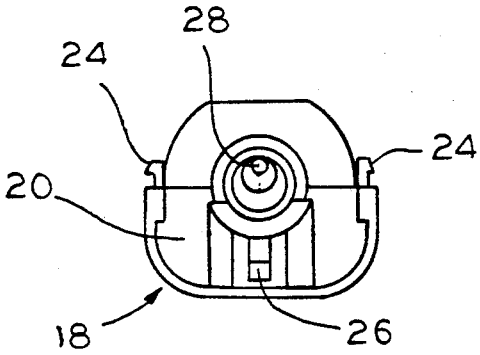
FIG. 3 is a front view of the apparatus shown in FIG. 2.

The blade assembly 16 (FIGS. 5 and 6) includes a base 32, a stationary blade 34, a reciprocating blade 36, and a wire tension spring 38. Mating protrusions 40 are provided which interlock with the resilient protrusions 24 on the front end 18 (FIGS. 2 and 3). An additional protrusion 42 is provided on the base 32 which interlocks with the handle 12 in the first orifice 26. In this manner, the blade assembly 16 is secured to the handle 12 by snapping the pieces together, without the use of tools. The blade assembly 16 can also be removed without the use of tools, by simply pulling the blade assembly 16 away from the handle 12.

Figure 5:
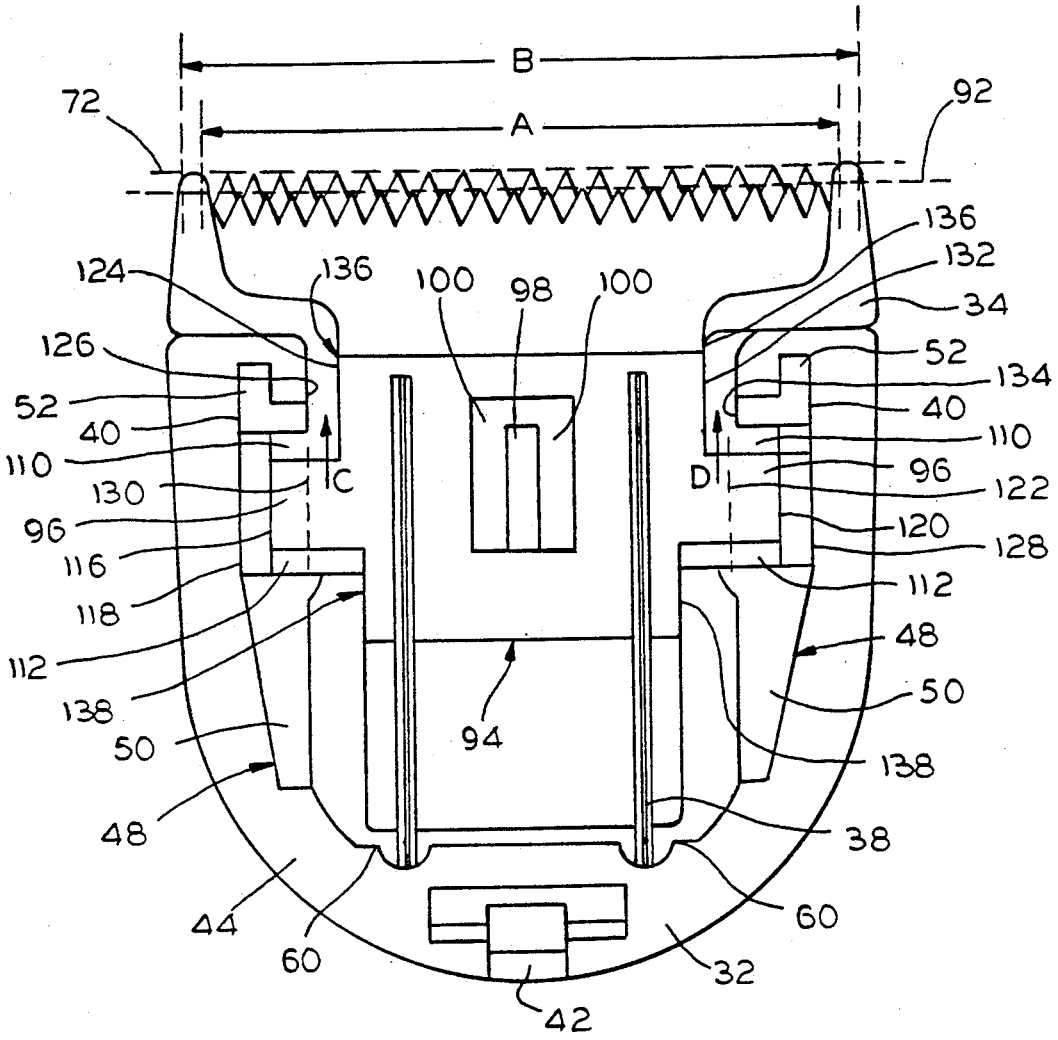
FIG. 5 is a detail view of a preferred embodiment of the inside of the blade assembly of FIG. 4.
Figure 11:
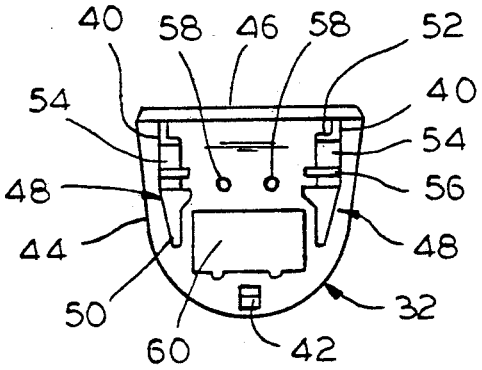
FIG. 11 is a detail view of the inside surface of the base of the blade assembly of FIG. 5.

In all embodiments, the base 32 includes a generally flat inside surface 44 and a straight first edge 46, as well as the mating protrusions 40 (FIGS. 5 and 11). Two spaced reciprocating blade guides 48 are located adjacent to the first edge 46. The blade guides 48 extend to approximately the inner surface of the cavity 22 of the handle 12 when installed.

Figure 12:
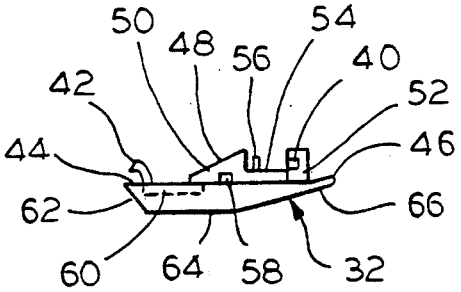
FIG. 12 is a side view of the base of FIG. 11.

The base 32 also includes two spaced stationary blade mounting posts 58 (FIGS. 11 and 12). The mounting posts 58 are perpendicular to the surface 44, and are used to secure the stationary blade 34 to the base 32, as will be seen.

Figure 6:
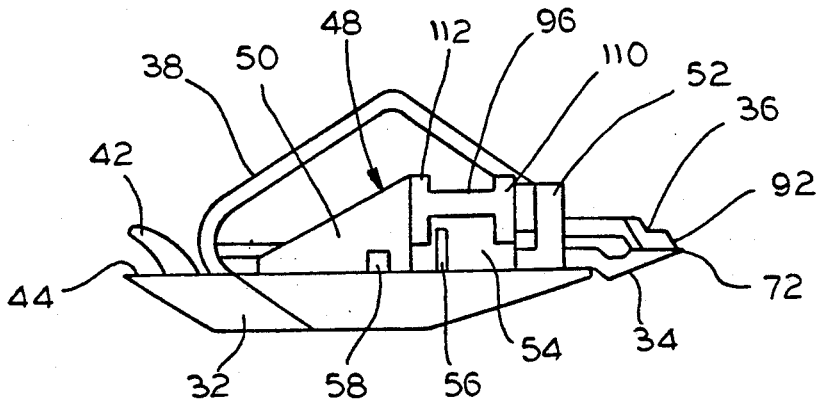
FIG. 6 is a right side view of the blade assembly of FIG. 5.

The base 32 of a preferred embodiment is shown in greater detail in FIGS. 5, 6, 11 and 12. In the preferred embodiment, each blade guide 48 includes a rear portion 50 and a front portion 52, which define first indentations 54 (FIGS. 6, 11 and 12). The rear portion 50 is wider than the front portion 52 (FIGS. 5 and 11). The first indentations 54 include anti-locking ribs 56 which are oriented parallel to the straight first edge 46 (FIGS. 6, 11 and 12).

In all embodiments, a second indentation 60 is provided in the base 32. The second indentation 60 is generally between the blade guides 48 and behind the mounting posts 58. When the blades 48, 50 are secured in the blade assembly 16, the second indentation 60 extends beyond the ends of the blades, as seen in FIG. 5.

Figure 4:
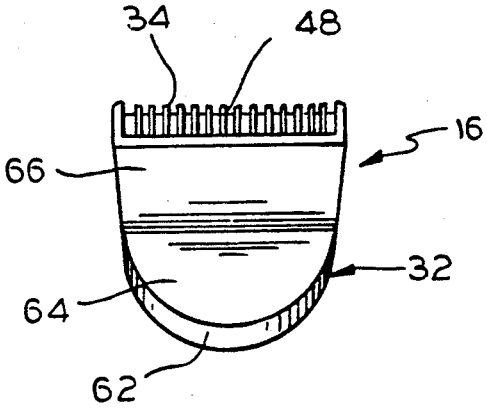
FIG. 4 is a detail view of the outside of the blade assembly of the clipper of FIG. 1.

The outside of the base 32, shown in FIG. 4, includes several surfaces 62, 64 and 66 which are provided so that the appearance of the base 32 fits well with the handle 12, in an aesthetically pleasing manner.

Figure 7:
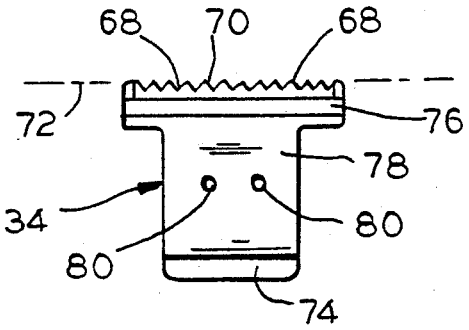
FIG. 7 is a view showing the cutting surfaces of the stationary blade of the blade assembly of FIG. 5.
Figure 8:
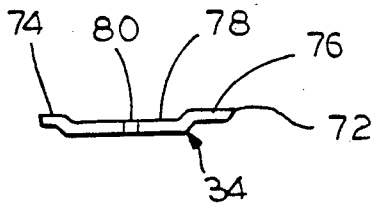
FIG. 8 is a side view of the stationary blade of FIG. 7.

As seen in FIGS. 7 and 8, the stationary blade 34 includes a plurality of first teeth 68 which are arranged in a substantially straight row. The first teeth 68 have first tips 70 which form a substantially straight blade edge 72. The blade 34 also includes first and second flat surfaces 74 and 76 which are parallel to the blade edge 72, a depressed area 78 between the surfaces 74 and 76, and two second orifices 80 in the depressed area 78. The mounting posts 58 fit through the second orifices 80 and are secured in a suitable manner to properly align and secure the blade 48 to the base 32.

Figure 13:
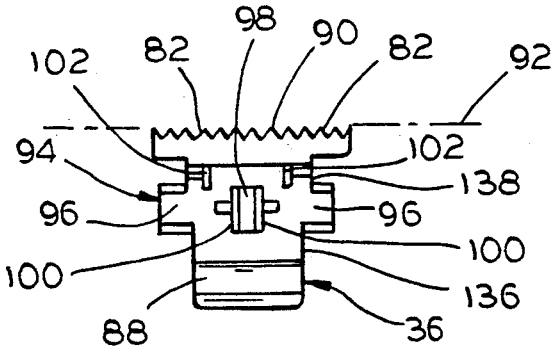
FIG. 13 is a top view of the reciprocating blade and the guide piece of FIG. 5.
Figure 23:
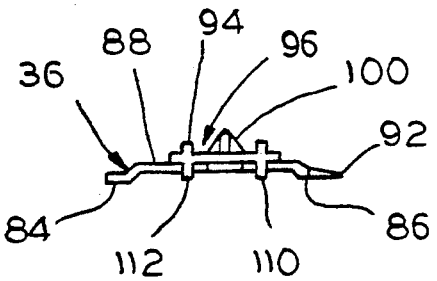
FIG. 23 is a side view of the preferred embodiment of the reciprocating blade and the guide piece shown in FIGS. 13, 16 and 19; and, FIG. 24 is a side view of an alternate embodiment of the guide piece of FIG. 23.
Figure 24:
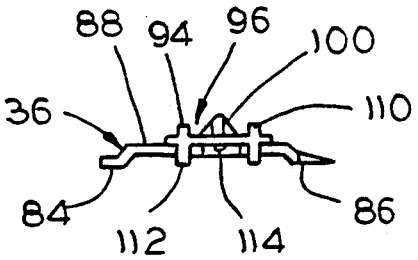

The reciprocating blade 36 is shown in greater detail in FIGS. 13, 23 and 24. The blade 36 includes a plurality of second teeth 82 (FIG. 13) which complement the stationary blade first teeth 68, a third flat surface 84 which complements the first flat surface 74, a fourth flat surface 86 which complements the second surface 76, and a raised portion 88 between the third and fourth surfaces 84 and 86. Second tips 90 of the second teeth 82 (FIG. 13) form a substantially straight line 92. The line 90 is substantially parallel to the blade edge 72 (FIG. 6) so that the teeth of the blades pass across each other properly as the reciprocating blade 36 moves back and forth during operation. The line 92 is preferably recessed somewhat from the blade edge 72 (FIG. 6), so that the moving second blade teeth 82 do not graze the skin during use.

A guide piece 94 is secured to the reciprocating blade 36 (FIGS. 13, 23 and 24). The guide piece 94 includes two guide bars 96 which fit into the rectangular first indentations 54 and engage the anti-locking ribs 56 (FIG. 6). The guide bars 96 extend from the sides of the guide piece 94, parallel to the straight line 92 (FIG. 5 and 13). The guide bars 96 control the movement of the reciprocating blade 36 so that the line 92 is maintained in a parallel relationship to the blade edge 72, throughout the operating stroke A, even under substantial cutting loads. However, when the blade assembly 16 is detached from the handle 12, for cleaning or other servicing, the reciprocating blade 36 can be moved manually through a maximum stroke distance B (FIG. 5). The guide bars 96 do not maintain the line 92 parallel to the blade edge 72 when the blade assembly 16 is removed from the handle 12 and the reciprocating blade 36 is moved sufficiently far enough beyond a distal end of the operating stroke A, so that one end of the guide bar becomes disengaged from the blade guide.

Engagement of the anti-locking ribs 56 and the guide bars 96 maintain the line 92 parallel to the blade edge 72 throughout the maximum stroke distance B. This prevents the guide bars 96 from being displaced out of the first indentations 54 and becoming locked in an immovable position against the outside of the blade guides 48 when the reciprocating blade 36 is moved the maximum distance B while detached from the handle 12, as will be described in greater detail.

The reciprocating blade 36 and the guide piece 94 include an elongated opening 98 (FIGS. 5 and 13) which is large enough for the cam eccentric 28. The guide piece 94 has two raised stops 100 which are on either side of the opening 98 so that the cam eccentric 28 alternately pushes the two stops 100 to move the blade 36 in a reciprocating motion. The stops 100 are elongated so that the cam eccentric 28 presses against one of the stops 100 throughout the entire range of its lateral movement. As the cam eccentric 28 is moved in a circular motion by the rotation of the shaft 30, the reciprocating blade is moved in a side to side motion through the stroke distance A (FIG. 5).

Figure 9:
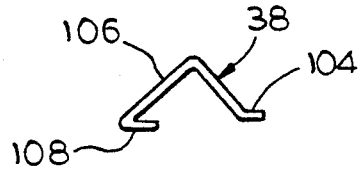
FIG. 9 is a side view of the wire tension spring of the blade assembly of FIGS. 5 and 6.
Figure 10:
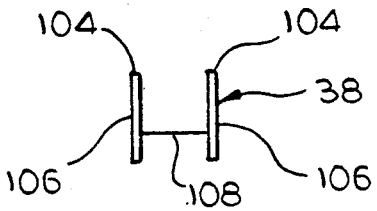
FIG. 10 is a front view of the wire tension spring of FIGS. 5 and 6.

The guide piece 94 also has two third indentations 102 (FIG. 13) which secure the ends of the wire tension spring 38, as will be seen. The wire tension spring 38, shown in detail in FIGS. 9 and 10, includes two second ends 104 which fit into the third indentations 102, two bent pieces 106 and a U-shaped underside 108 which joins the bent pieces 106. When the blade assembly 16 is assembled, as in FIG. 6, the underside 108 is placed beneath the stationary blade 34 in the second indentation 60, and the ends 104 are located in the third indentations 102 of the guide piece 94 (FIG. 5). The spring 38 places tension spring pressure on the reciprocating blade 36 which holds the blade 36 against the stationary blade 34 without preventing the blade 36 from reciprocating. The second ends 104 move back and forth with the reciprocating blade 36.

In one embodiment, the guide bars 96 are "H" shaped with a front upright 110 and a rear upright 112 (FIG. 23). The anti-locking ribs 56 engage both the left and right uprights 112 (FIGS. 5 and 6).

In another embodiment, the guide bars 96 have a modified "H" shape (FIG. 24) with a front upright 110, a rear upright 112 and a middle projection 114. This shape allows a closer engagement of the guide bars 96 with the anti-locking ribs 56.

The invention can perhaps be better understood with reference to a preferred embodiment, as seen in FIG. 5. The number of teeth in the blades, and the size of and spacing between the teeth, are determined by design constraints and the application for the hair clipper. The operating stroke A is related to the size and spacing of the blade teeth. However, when the reciprocating blade 36 is removed from the handle 12, the blade 36 can be manually moved over a maximum stroke distance B which is greater than the operating stroke A. The blade 36 can be moved to the left in FIG. 5 until the first left edge 116 of the guide bars 96 reaches a left distal end 118. When the first left edge 116 is at the left distal end 118, the first right edge 120 of the guide bars 96 is at a right point 122 on the right side of the base 32. The left distal end 118 is reached when the blade 36 first contacts the left blade guide 48. This could happen, for example, if the second left edge 124 of the blade 36 first contacts the third right edge 126 of the front portion 52 of the left blade guide 48.

The blade 36 can be moved to the right in FIG. 5 until the first right edge 120 of the guide bars 96 reaches a right distal end 128. When the first right edge 120 is at the right distal end 128, the first left edge 116 of the guide bars 96 is at a left point 130 on the left side of the base 32. The right distal end 128 is reached when the blade 36 first contacts the right blade guide 48. This could happen, for example, if the second right edge 132 of the blade 36 first contacts the third left edge 134 of the front portion 52 of the right blade guide 48.

As can be seen in FIG. 5, the left point 130 is inside the third right edge 126, and the right point 122 is inside the third left edge 134. The third edges 126 and 134 cannot be extended inwardly without reducing the operating stroke, which is undesirable. Additionally, the second edges 124 and 132 cannot be moved closer together since this could cause the reciprocating blade 36 to have less than the desired rigidity. Thus, in the absence of additional structure, the left guide bars 96 could be pushed up when at the distal point 130, as indicated in FIG. 5 by the arrow C, and the first left edge 116 could lock against the third right edge 126, rendering the reciprocating blade 36 inoperable. This could also happen if the right guide bars 96 were pushed up when at the distal point 122, as indicated in FIG. 5 by the arrow D, and the first right edge 120 could lock against the third left edge 134.

The present invention solves this problem without shortening the operating stroke and without placing additional frictional load on the motor, by placing the anti-locking ribs 56 adjacent one upright 112 (FIG. 6), or 110 (FIG. 15) of the guide bars 96, in the manner shown in FIG. 6. In this manner, the blade line 92 of the reciprocating blade 36 is maintained parallel to the blade edge 72 throughout the maximum distance B through which the blade 36 can travel.

The structure by which this invention is implemented depends in part on the structure of the blade assembly 16, specifically, the blade guides 48 and guide piece 94. In a preferred embodiment of the blade assembly 16, shown in FIGS. 5, 6, 11–13, the rear portions 50 of the blade guides 48 are wider than the front portions 52 (FIG. 11), and the front section 136 of the guide piece 94 is wider than the rear section 138 (FIG. 13). Also, the guide bars 96 have an "H" shape, as seen in FIGS. 6 and 23.

In this embodiment, the anti-locking ribs 56 are located to the rear of the first indentations 54 (FIGS. 11 and 12), and engage the rear uprights 112 (FIG. 6). Alternatively, the guide bars 96 could have the modified "H" shape, shown in FIG. 24, allowing the anti-locking ribs to engage both the rear upright 112 and the middle projection 114.

Figure 14:
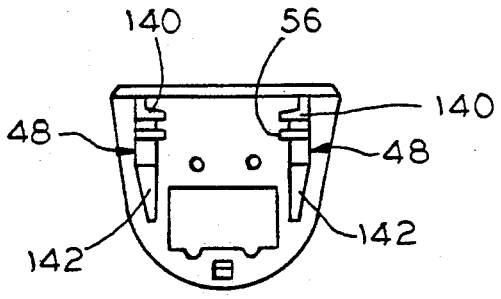
FIG. 14 is a detail view of an alternate embodiment of the inside surface of the base of the blade assembly of FIG. 11.
Figure 15:
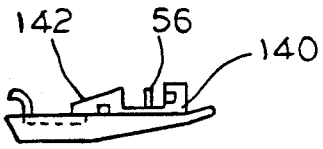
FIG. 15 is a right side view of the base of FIG. 14.
Figure 16:
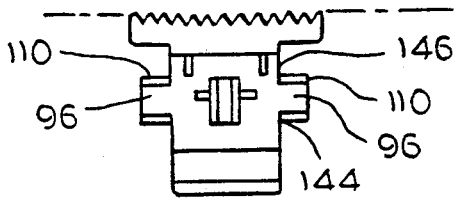
FIG. 16 is a top view of an alternate embodiment of the reciprocating blade and guide piece of FIG. 13.

In another embodiment, shown in FIGS. 14–16, the front portions 140 of the blade guides 48 are wider than the rear portions 142 (FIG. 14), and the rear section 144 of the guide piece 94 is wider than the front section 146 (FIG. 16). The guide bars 96 have an "H" shape, and the anti-locking ribs 56 are located to the front of the first indentations 54 (FIG. 14 and 15), engaging the front uprights 110. Alternatively, the guide bars 96 could have the modified "H" shape shown in FIG. 24, allowing the anti-locking ribs to engage both the front upright 110 and the middle projection 114.

Figure 17:
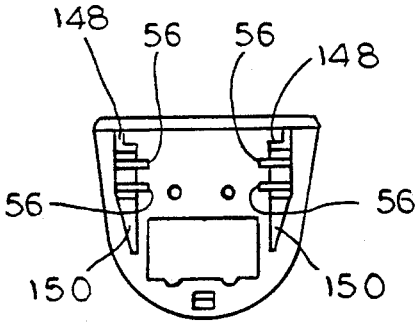
FIG. 17 is a detail view of an alternate embodiment of the inside surface of the base of the blade assembly of FIG. 12.
Figure 18:
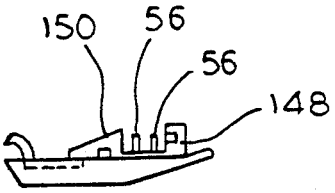
FIG. 18 is a right side view of the base in FIG. 17.
Figure 19:
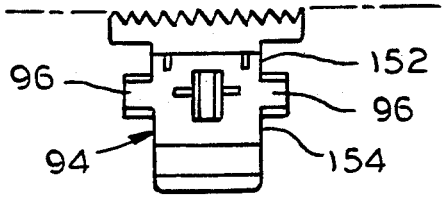
FIG. 19 is a top view of an alternate embodiment of the reciprocating blade and the guide piece of FIG. 13.

In a third embodiment, shown in FIGS. 17–19, the relative widths of the front portions 148 and the rear portions 150 are generally equal (FIG. 17). The front section 152 of the guide piece 94 is the same width as the rear section 154 (FIG. 19), and the guide bars 96 have an "H" shape. The anti-locking ribs 56 are located both to the front and to the back of the first indentations 54, (FIGS. 17 and 18) engaging both uprights 112 and 110 (not shown). Alternatively, the anti-locking ribs 56 could be made so that a single anti-locking guide rib 56 engages both uprights 112 and 110 (not shown). In addition, the guide bars 96 could have a modified "H" shape (FIG. 24), and the anti-locking ribs could be located either to the front or the rear of the first indentations 54, engaging the middle projection 114 and either the front upright 110 or the rear upright 112.

Figure 20:
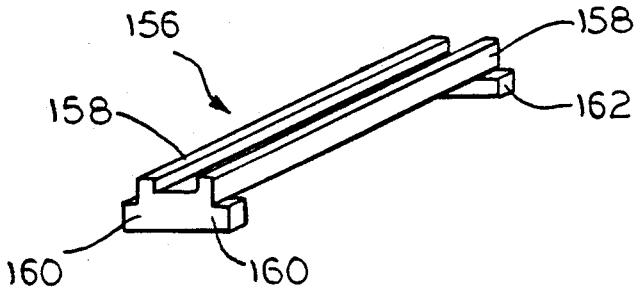
FIG. 20 is a perspective view of an anti-lock bar used in another alternate embodiment of the invention.
Figure 21:
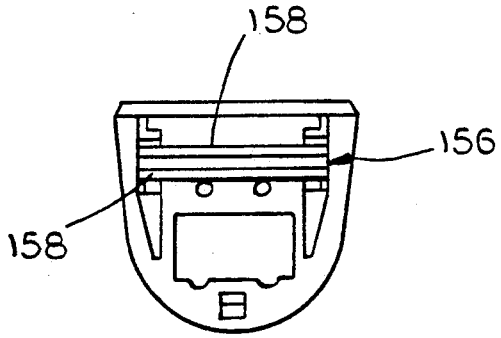
FIG. 21 is a top view of an additional alternate embodiment of the inside surface of the base of the blade assembly of FIG. 5, which uses the anti-lock bar shown in FIG. 20.
Figure 22:
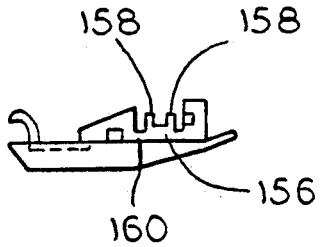
FIG. 22 is a side view of the apparatus of FIG. 21.

In a fourth embodiment, an anti-lock bar 156 (FIG. 20) is secured within the first indentations 54 (FIGS. 21 and 22). The anti-lock bar 156 includes spaced upright projections 158 (FIG. 20) extending parallel to the blade edge 72 which engage the uprights 112 and 110. Legs 160, 162 extend over the blade guide 48, as shown in FIG. 22. The anti-locking bar 156 may be used in conjunction with any previous embodiments in place of the anti-lock ribs 56.

The blade assembly 16 may be assembled by placing the U-shaped underside 108 of the wire spring 38 in the base 32. Part of the underside 108 is placed in the second indentation 60. The stationary blade 34 is placed over the underside 108 so that the underside 108 of the wire spring 38 is beneath the blade 34. The blade guide posts 58 fit inside the second orifices 88 in the blade 34 to maintain the blade 34 in a fixed predetermined position.

The guide piece 94 is secured to the reciprocating blade 36 by any suitable means, such as a press fit if the guide piece 94 is made of plastic. The reciprocating blade assembly is then placed under the bent pieces 106 of the wire tension spring 38, and the ends 104 of the tension spring 38 are placed in the third indentations 102 of the guide piece 94. The guide bars 96 fit into the rectangular first indentations 54 and over the anti-locking ribs 56 in the base 32. The teeth 84 align with the teeth 68, the surface 84 aligns with the surface 86, and the surface 82 aligns with the surface 84. The assembled blade assembly 16 is then secured to the handle 12 by snapping the pieces together. The mating protrusions 40 interlock with the resilient protrusions 24, and the additional protrusion 42 locks in the handle 12 through the first orifice 26. The blade assembly 16 may be easily removed without the use of hand tools by simply pulling the blade assembly off of the handle 12 with the fingers.

When the blade assembly 16 is secured to the handle 12, the cam eccentric 28 enters the opening 98 in the guide piece 94. In operation, rotation of the cam eccentric 28 causes the reciprocating blade 36 to move back and forth through the stroke distance A, and hair strands which enter the spaces between teeth are cut as the blade reciprocates. The teeth 82 of the reciprocating blade 36 are maintained parallel in relation to the blade edge 76 as the blade 36 reciprocates, by the engagement of the guide bars in the blade guide even under heavy cutting loads.

When detached from the handle, the reciprocating blade 36 is capable of being moved by external forces through a maximum stroke B. Through the use of the anti-locking ribs or the anti-lock bar, the teeth 82 of the reciprocating blade 36 are maintained parallel in relation to the blade edge 76 as the blade 36 is pushed to the distal ends of the maximum stoke B. In this manner, the reciprocating blade guide piece does not become dislodged from the blade guide during cleaning or other servicing.

The many advantages of this invention are now apparent. The teeth of the reciprocating blade are maintained parallel to the blade edge of the stationary blade, even under substantial cutting loads, without the addition of frictional resistance to the motor. The reciprocating blade cannot be accidentally displaced out of the blade guide when the blade assembly is detached from the handle and the blade is pushed towards the distal ends of the maximum stroke while servicing. Also, the blade assembly of the hair clipper may be removed and reassembled easily without the use of hand tools, such as screw drivers.

While the principles of this invention have been described above in connection with specific apparatus and applications, it is to be understood that this description is made only by way of example and not as a limitation of the scope of the invention.

What is claimed is:

1. An electric hair clipper comprising a handle and a blade assembly, said blade assembly having:

a base having means for securing said assembly to said clipper handle, a stationary blade secured to said base, said stationary blade having a plurality of stationary teeth arranged in a row, said stationary teeth having tips which form a substantially straight blade edge, a reciprocating blade having a plurality of teeth which complement said stationary blade teeth, said reciprocating teeth having tips which form a substantially straight line substantially parallel to and adjacent to said blade edge, said reciprocating blade being slidable over a maximum distance, spring means for slidably pressing said reciprocating blade against said stationary blade for reciprocation of said reciprocating blade, means for moving said reciprocating blade within said maximum distance so that said reciprocating blade travels over a predetermined operating stroke distance, said operating stroke distance being shorter than said maximum distance, first means for maintaining said line parallel to said blade edge throughout said stroke distance, even under substantial cutting loads, but not throughout said maximum distance, and separate second means for maintaining said blade edge parallel to said line when said reciprocating blade edge is manually moved in excess of the stroke distance and up to the maximum distance.

2. The assembly of claim 1 wherein said first means for maintaining said reciprocating blade teeth parallel to said blade edge during movement of said reciprocating blade includes at least one guide bar secured to said reciprocating blade and extending parallel to said blade edge, and blade guides located on said base, each of said blade guides containing an indentation for each of said guide bars, said indentations being parallel to said blade edge, said guide bars slidably engaging said indentations in said blade guides throughout said operating stroke, but at least one guide bar becoming disengaged from its corresponding indentation when said reciprocating blade is manually moved throughout said maximum stroke, said second means for maintaining said blade edge parallel to said line throughout said maximum stroke including anti-locking ribs located on each of said indentations which engage said guide bars so that said line is maintained parallel to said blade edge throughout said maximum stroke.

3. The assembly of claim 2 wherein said blade guides have a front portion adjacent said blade edge and a rear portion, said front and rear portions defining said indentation, said guide bars having an H-shaped profile having a front upright adjacent said front portion and a rear upright adjacent said rear portion.

4. The assembly of claim 3 wherein said blade guide is wider in front of said guide bars than behind said guide bars, said blade guide rear portion being proportionally wider than said blade guide front portion, and said anti-locking ribs being located to the rear of said indentations, engaging said rear upright of said guide bar.

5. The assembly of claims 3 wherein said blade guide is wider behind said guide bars than in front of said guide bars, said blade guide front portion being proportionally wider than said blade guide rear portion, and said anti-locking ribs being located to the front of said indentation, engaging said front upright of said guide bars.

6. The assembly of claim 3 wherein the said blade guide is of equal width in front of and behind said guide bars, said blade guide front portion being of equal width to said blade guide rear portion, said anti-locking ribs being located in both the front and rear of said indentation, engaging both said front upright and said rear upright of said guide bars.

7. The assembly of claim 3 wherein said guide bars further include a downward projection between said front and rear uprights and adjacent said anti-locking ribs for more secure engagement of said anti-locking ribs.

8. The assembly of claim 7 wherein said anti-locking ribs are located between said downward projection and said front upright, said guide strip engaging both said projection and said front upright.

9. The assembly of claim 7 wherein said anti-locking ribs are located between said downward projection and said rear upright, said anti-locking ribs engaging both said projection and said rear upright.

10. The assembly of claim 1 wherein said first means for maintaining said reciprocating blade teeth parallel to said blade edge during movement of said reciprocating blade includes at least one guide bar secured to said reciprocating blade and extending parallel to said blade edge, and blade guides located on said base, each of said blade guides containing an indentation for each of said guide bars, said indentations being parallel to said blade edge, said guide bars engaging said blade guides throughout said operating stroke, at least one guide bar not engaging said blade guide throughout said maximum stroke, said second means for maintaining said blade edge parallel to said line throughout said maximum stroke including an anti-lock bar secured within said indentations, said anti-lock bar having at least one upright projection which engages said guide bars, said upright projection extending parallel to said blade edge.

* * * * *